US006257203B1

(12) United States Patent
Lei

(10) Patent No.: US 6,257,203 B1
(45) Date of Patent: Jul. 10, 2001

(54) INJECTOR WITH VARIABLE NEEDLE VALVE OPENING PRESSURE

(75) Inventor: Ning Lei, Oak Brook, IL (US)

(73) Assignee: International Truck and Engine Corporation, Chicago, IL (US)

( * ) Notice: Subject to any disclaimer, the term of this patent is extended or adjusted under 35 U.S.C. 154(b) by 0 days.

(21) Appl. No.: 09/501,253

(22) Filed: Feb. 10, 2000

(51) Int. Cl.[7] ..... F02M 33/04

(52) U.S. Cl. ..... 123/446; 123/496

(58) Field of Search ..... 123/446, 506, 123/467, 496; 239/88–96, 124

(56) References Cited

U.S. PATENT DOCUMENTS

| | | | | |
|---|---|---|---|---|
| 5,181,494 | | 1/1993 | Ausman et al. . | |
| 5,460,329 | | 10/1995 | Sturman . | |
| 5,673,669 | * | 10/1997 | Maley et al. | 239/96 |
| 5,682,858 | | 11/1997 | Chen et al. . | |
| 5,697,342 | * | 12/1997 | Anderson et al. | 123/446 |
| 5,819,710 | * | 10/1998 | Huber | 123/498 |
| 5,860,597 | * | 1/1999 | Tarr | 239/124 |
| 5,979,803 | * | 11/1999 | Peters et al. | 239/95 |
| 5,984,200 | * | 11/1999 | Augustin | 239/88 |
| 6,079,641 | * | 6/2000 | Shinogle et al. | 239/96 |
| 6,085,990 | * | 7/2000 | Augustin | 239/88 |
| 6,092,744 | * | 6/2000 | Youakim | 239/88 |
| 6,119,962 | * | 9/2000 | Youakim | 239/124 |

OTHER PUBLICATIONS

C. Cole, O.E. Sturman, D.Giordano, Application of Digital Valve Technology to Diesel Fuel Injection, 1999–01–0196. pp. 1 to 7, Society of Automotive Engineers, Inc.

* cited by examiner

*Primary Examiner*—Thomas N. Moulis
(74) *Attorney, Agent, or Firm*—Dennis Kelly Sullivan; Jeffrey P. Calfa; Gilberto Hernandez

(57) ABSTRACT

A hydraulically-actuated electronically-controlled fuel injector for use with a fuel injection system having an actuating fluid high pressure common rail for conveying an actuating fluid under pressure, the pressure of the actuating fluid in the common rail being selectively variable, the fuel injection system being installed on a diesel engine, the injector having a controller valve for selectively porting the actuating fluid to an injector intensifier assembly for magnifying the pressure of the fuel to be injected, includes a needle valve for controlling the opening and closing of a fuel injection orifice to effect a fuel injection event, the needle valve being shiftable between a closed disposition and an open disposition, a return spring exerting a bias on the needle valve tending to urge the needle valve into the closed disposition. A variable valve opening pressure assembly is operably couplable to the needle valve for continuous fluid communication of the actuating fluid from the common rail, the actuating fluid exerting a selectively variable bias for transmission to the needle valve tending, the bias exerting a force on the needle valve tending to urge the needle valve into the closed disposition, the selectively variable bias effecting a variable needle valve opening pressure. A method of varying the valve opening pressure of an injector valve of a fuel injector, the injector valve being operably coupled to a diesel engine and being controlled by a controller valve includes a number of steps.

51 Claims, 4 Drawing Sheets

INJECTOR WITH VARIABLE NEEDLE VALVE OPENING PRESSURE

TECHNICAL FIELD

The present invention relates to hydraulically-actuated, electronically-controlled fuel injectors and systems therefor.

BACKGROUND OF THE INVENTION

Hydraulically-actuated, electronically-controlled fuel injectors and systems are known. Examples of such injectors and systems are shown in U.S. Pat. No. 5,460,329 to Sturman, U.S. Pat. No. 5,181,494 to Ausman et al., and U.S. Pat. No. 5,682,858 to Chen et al.

In the design alternative depicted in FIG. 6 of Sturman, the back of the needle valve is fluidly coupled directed to the high pressure actuating fluid source. It is significant to note that this embodiment does not utilize a spring to close the needle valve. The intention of the embodiment is to eliminate the needle valve spring and to use only actuating fluid rail pressure to close the needle valve. In this embodiment, there is no means for amplifying the actuating fluid pressure acting at the back of the needle valve. The needle valve front and the needle valve back have equally sized pressurized areas. A deficiency of this design is that the needle valve may have uncontrolled opening (since there is no valve spring to maintain the needle valve in the closed condition) when combustion cylinder pressure acting on the needle valve is relatively high and when the actuating fluid common rail pressure is relatively low, for example, during engine cranking or low speed engine operation.

Chen et al. incorporates a needle valve control chamber. The fluid pressure in the control chamber is directly controlled by the injector solenoid valve. The solenoid valve exposes the chamber to either the pressure in the actuating fluid high pressure rail or to ambient pressure as a function of solenoid valve position. When the control chamber is vented to ambient, the needle valve opens by fuel pressure acting counter to the relatively small needle spring. Such an arrangement indicates that the needle opening pressure in all cases is disadvantageously at the relatively low fuel injection pressure necessary to overcome the bias of the relatively small needle valve spring. The disadvantage of this design carries across the entire engine speed and load range. When the needle valve control chamber is exposed to the actuating fluid rail pressure, the needle valve closes by the total force of the actuating fluid acting on the needle valve and the force of the needle valve spring. This needle valve closing force can be very great at high actuating fluid rail pressure. The rail pressure force is amplified by the piston in the needle valve control chamber acting on the back of the needle valve.

Typically, in the conventional prior art HEUI type injector shown in Ausman et al., needle valve operation is controlled by a fixed mechanical return spring opposed by a force generated by fuel pressure acting on the needle valve. The preload on the conventional spring is predefined. Accordingly, the needle opens and closes at fixed fuel pressures under all engine operating conditions. Selecting the return spring load involves some tradeoffs between high speed high load operability and low speed operability. If the prior art return spring load is selected based on the rated engine condition performance requirements, then, the return spring load could be too great for lower speed conditions, especially idle conditions. High valve opening pressure produces significantly greater engine operation noise, a particularly undesirable effect. At engine idle condition, with a heavy spring, the engine operation noise becomes even more pronounced. Reducing diesel engine idle noise is a critical challenge to make the diesel engine acceptable for use in family transportation vehicles, such as pickup trucks and SUV's. Reducing idle noise is a key for the diesel engine manufacturer to be able to compete in what is now a largely gasoline engine market. The low valve opening pressures of the present invention offer a significant competitive advantage.

There is a need in the industry to provide a hydraulically-actuated, electronically-controlled fuel injector and system with variable needle valve valve opening pressure. The mechanization necessary to provide such variable valve opening pressure should be designed in the most simplistic way possible in order to minimize the difficulty in constructing the injector, minimize the complexity of the injector, and in order to minimize the cost of the injector.

SUMMARY OF THE INVENTION

The injector and injector system of the present invention substantially meet the aforementioned needs of the industry. The present injector incorporates variable needle valve opening pressure at widely differing engine operation conditions. The variable needle valve opening pressure of the present invention effects needle valve opening at relatively low fuel injection pressure when the engine is at idle condition. The benefit of such opening is to favorably reduce low engine idle noise. Further, the variable needle valve opening pressure of the present invention effects a higher valve opening pressure at high engine speed in the engine load conditions. The higher valve opening pressure provides for a desirable higher average fuel injection pressure. The higher average fuel injection pressure of the present invention effects reduced engine emissions and improved vehicle driveability.

Since, as indicated above, there is a need to provide a lower valve opening pressure at low engine load conditions and a relatively higher valve opening pressure at higher engine speed and load conditions, there is a further need to find a relatively simple way to provide the desired valve opening pressures. With the fuel injection systems of the present invention, actuating fluid rail pressure has a special characteristic in that the pressure normally increases with engine speed and load. With the common rail pressure being already available to each of the injectors, the special characteristic of the rail pressure was used in the present invention to generated the desired valve opening pressures. In a preferred embodiment, the variable actuating fluid at the rail pressure is introduced at the needle valve back to effect the variable valve opening pressure. In a preferred embodiment, a piston acting on the needle valve back is utilized to amplify the effect of the actuating fluid rail pressure on the needle valve as desired.

The present invention provides for higher valve opening pressure as the desired injection pressure increases. The higher valve opening pressure attained by the present inventions allows the needle valve to delay opening at relatively higher injection pressures and closes the needle valve earlier at such relative higher injection pressures. Compared to the aforementioned lower valve opening pressure condition, the average injection pressure is much higher under the higher valve opening pressure condition. The high average injection pressure that is made possible by the higher valve opening pressure of the present invention contributes to dramatically reduce engine emissions and improve driveability under such conditions.

With the present invention, the total force on the back of the needle valve is a function of actuating fluid rail pressure (with a fixed bias provided by the needle valve return spring). The injection pressure at which the needle valve starts to open with the present invention is a linear function of actuating fluid rail pressure. This is one of the fundamental aspects of the present invention.

The present invention is a hydraulically-actuated electronically-controlled fuel injector for use with a fuel injection system having an actuating fluid high pressure common rail for conveying an actuating fluid under pressure, the pressure of the actuating fluid in the common rail being selectively variable, the fuel injection system being installed on a diesel engine, the injector having a controller valve for selectively porting the actuating fluid to an injector intensifier assembly for magnifying the pressure of the fuel to be injected, includes a needle valve for controlling the opening and closing of a fuel injection orifice to effect a fuel injection event, the needle valve being shiftable between a closed disposition and an open disposition, a return spring exerting a bias on the needle valve tending to urge the needle valve into the closed disposition. A variable valve opening pressure assembly is operably couplable to the needle valve and is in direct fluid communication with the actuating fluid in the common rail, the actuating fluid exerting a selectively variable bias for transmission to the needle valve tending, the bias exerting a force on the needle valve tending to urge the needle valve into the closed disposition, the selectively variable bias effecting a variable needle valve opening pressure.

The present invention is further a method of varying the valve opening pressure of an injector valve of a fuel injector, the injector valve being operably coupled to a diesel engine and being controlled by a controller valve, comprising the steps of:

operably fluidly coupling the injector needle valve to a source of actuating fluid under pressure;

biasing the injector needle valve in a closed disposition by means of the actuating fluid under pressure; and selectively varying the pressure of the actuating fluid to vary the bias acting on the injector needle valve, the variable bias defining in part a variable force which must be overcome in order to open the injector needle valve.

DETAILED DESCRIPTION OF THE DRAWINGS

Figure 1:
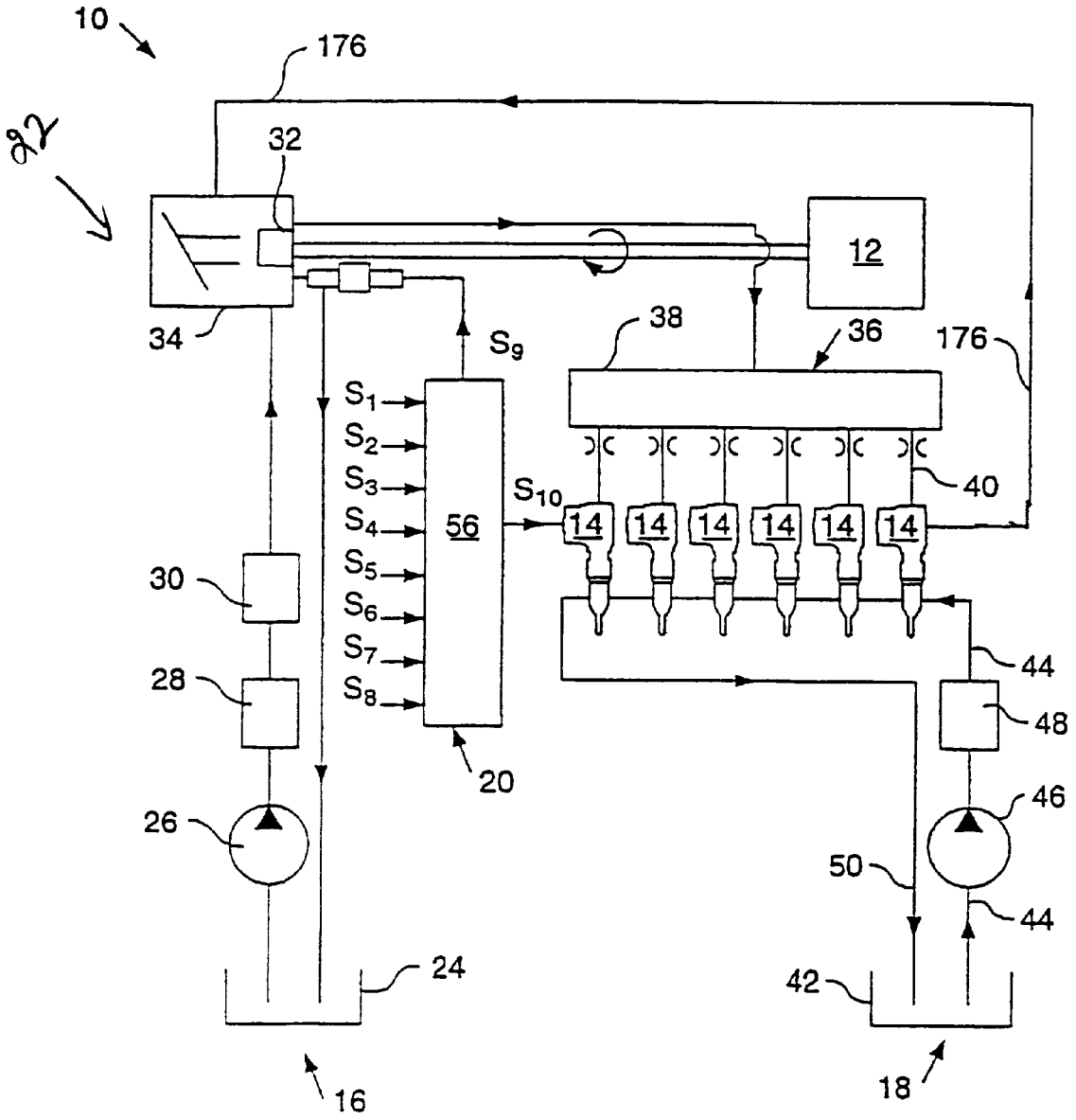
FIG. 1 is a diagrammatic general schematic view of a hydraulically-actuated electronically-controlled injector fuel system of the present invention, including an actuating fluid circuit and a fuel injection circuit, for an internal combustion engine having a plurality of injectors.

Referring to FIGS. 1–4*b*, wherein similar reference numerals designate similar elements or features throughout the figures, there is shown an embodiment of a hydraulically-actuated electronically-controlled injector fuel system 10 (hereinafter referred to as a HEUI fuel system).

The exemplary HEUI fuel system 10 is shown in FIG. 1 as adapted for a direct-injection diesel-cycle internal combustion engine 12. While the embodiment of FIG. 1 is shown applicable to an in-line six cylinder engine, it should be understood that the present invention is also applicable to other types of engines, such as vee-type engines and rotary engines, and that the engine 12 may contain fewer or more than six cylinders or combustion chambers. The engine 12 includes at least one cylinder head (not shown) having one or more injector bores (not shown).

The HEUI fuel system 10 includes one or more hydraulically-actuated electronically-controlled injectors 14, such as unit fluid injectors, each adapted to be positioned in a respective cylinder head bore. The system 10 further includes hydraulically-actuating fluid supply 16 for supplying hydraulically-actuating fluid to each injector 14, fuel supply 18 for supplying a fluid such as fuel to each injector 14, and an electronic controller 20 for electronically controlling the fuel injection quantity, injection timing, and/or actuating fluid pressure of the HEUI fuel system 10 independent of engine speed.

The hydraulically-actuating fluid supply 16 preferably includes an actuating fluid sump 24, a relatively low pressure actuating fluid transfer pump 26, an actuating fluid cooler 28, one or more actuating fluid filters 30, a source or means for generating relatively high pressure actuating fluid (such as, for example, a relatively high pressure actuating fluid pump 34), at least one relatively high pressure actuating fluid manifold 36. The high pressure actuating fluid pump 34 preferably includes a rail pressure control valve (RPCV) 32.

Preferably, the fluid chosen for the actuating fluid is not fuel but is a relatively incompressible liquid having a relatively higher viscosity than fuel under the same conditions. Preferably, the actuating fluid is engine lubricating oil and the actuating fluid sump 24 is an engine lubrication oil sump. Alternatively, the actuating fluid may be fuel provided by the fuel tank 42 or another source.

Preferably, one actuating fluid manifold 36 is provided for and associated with each cylinder head having a bank of injectors 14. Each actuating fluid manifold 36 has one common rail passage 38 and a plurality of rail branch passages 40 extending from the common rail passage 38.

The common rail passage 38 is arranged in fluid communication with and downstream of the relatively high pressure actuating fluid pump 34. The number of rail branch passages 40 for each manifold 36 corresponds to the number of injectors 14 positioned in each cylinder head. Each rail branch passage 40 is arranged in fluid communication between the common rail passage 38 and an actuating fluid inlet of a respective injector 14.

The fuel supply 18 preferably includes a fuel tank 42, a fuel supply passage 44 arranged in fluid communication between the fuel tank 42 and a fuel inlet of each injector 14, a relatively low pressure fuel transfer pump 46, one or more fuel filters 48, and a fuel drain passage 50 arranged in fluid communication between the injector(s) 14 and the fuel tank 42. Preferably, each cylinder head defines an internal fuel supply passage 44 which communicates with an annular fuel inlet 52 of each injector 14 associated with the respective cylinder head.

Preferably, each cylinder head also defines a separate internal fuel drain passage 50 which communicates with a fuel outlet 54 of each injector 14 associated with the respective cylinder head. Alternatively, the fuel supply passage 44 and the fuel drain passage 50 defined in the cylinder head may be a single internal passage. Alternatively, the passages 44, 50 may be a single or pair of external lines positioned outside of the cylinder head. Optionally, a sleeve (not shown) may be sealedly positioned in the injector bore radially between the injector 14 and the cylinder head to separate internal coolant chambers of the cylinder head from the injector 14.

The electronic controller 20 preferably includes an electronic control module 56 which controls (1) the fuel injection timing, (2) the total fuel injection quantity during an injection cycle, (3) the fuel injection pressure, (4) the number of separate injections or injection segments during an injection cycle, (5) the time interval(s) between the injection segment(s), (6) the fuel quantity of each injection segment during an injection cycle; and (7) any combination of the above parameter(s) between a plurality of injectors 14. It is known that each of the above parameters are variably controllable independent of engine speed and load. The RPCV 32 is an electrically operated dump valve which closely controls pump output pressure by dumping excess flow to the return circuit. A variable signal current from the controller 20 to the RPCV 32 determines pump output pressure. Pump pressure can be maintained anywhere between about 100 psi and 4,000 psi during normal engine operation. Depending on engine speed and load conditions and desirable operating characteristics, e.g., emissions, such control of rail pressure is known.

Figure 2:
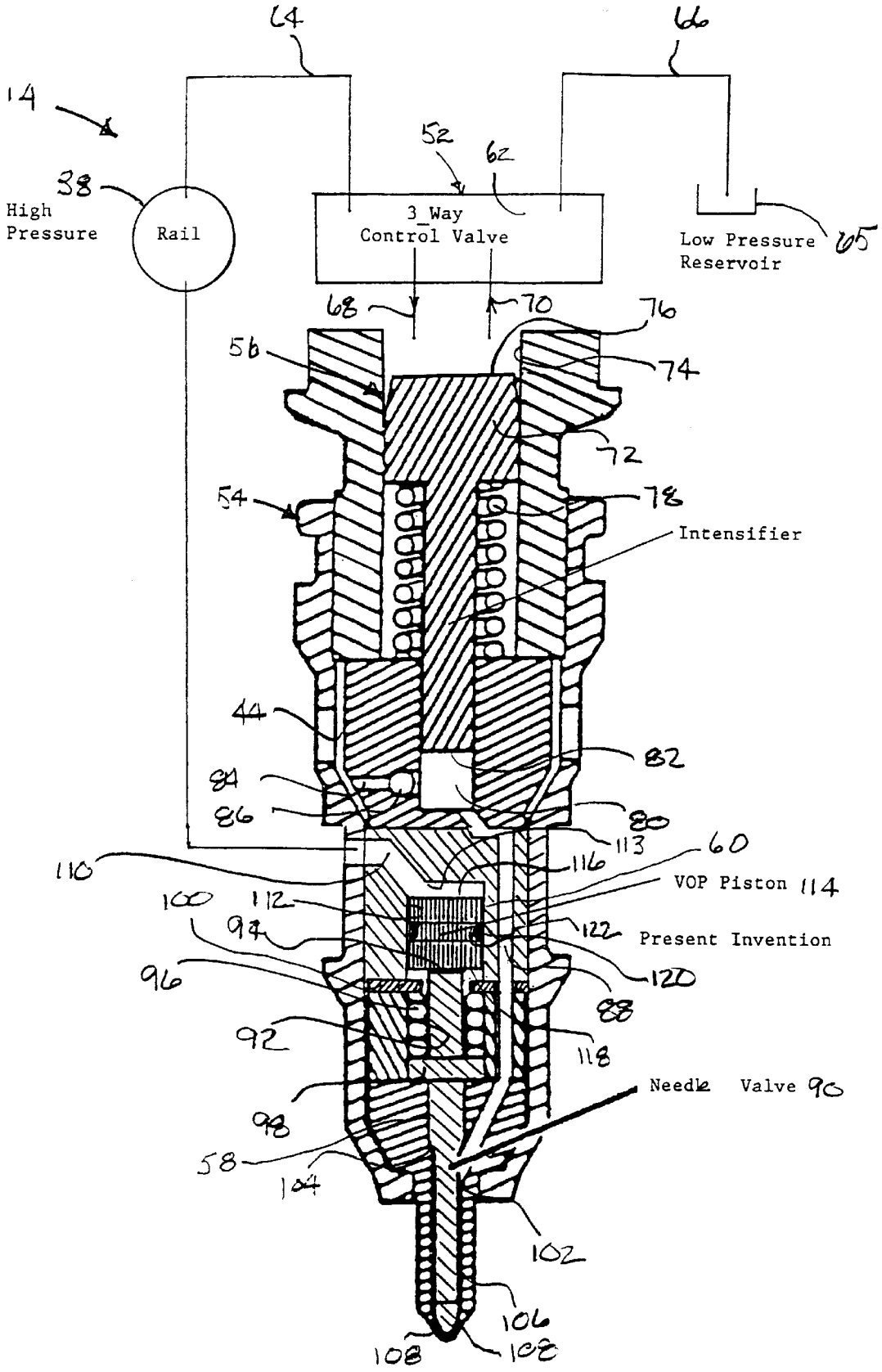
FIG. 2 is a sectional view of an exemplary HEUI type injector incorporating the present invention.

An exemplary HEUI injector 14 is depicted in FIG. 2. The injector 14 has five major assemblies: control valve assembly 52, injector body 54, intensifier assembly 56, needle valve assembly 58, and variable VOP assembly 60.

The control valve assembly 52 of the injector 14 is depicted schematically in FIG. 2. Reference may be had to U.S. Pat. No. 5,181,494 to Ausman et al. for a more detailed description of the control valve assembly 52. Preferably, the control valve assembly 52 includes a solenoid 62. The solenoid 62 is in fluid communication with the actuating fluid high pressure rail 38 by means of a high pressure actuating fluid passage 64. The solenoid 62 is further in fluid communication with a low pressure reservoir 65 by means of an ambient pressure actuating fluid passage 66. In practice, the low pressure reservoir 65 may be the engine oil sump. After discharge by the solenoid 62, the actuating fluid is free to flow through passages defined in the engine 12 to the sump (reservoir 65).

The solenoid 62 controls an inlet port 68 and an outlet port 70. When opened by the solenoid 62, the inlet port 68 ports high pressure actuating fluid from the rail 38 to the intensifier assembly 56. Similarly, when the outlet port 70 is opened by the solenoid 62, actuating fluid is discharged from the intensifier assembly 56 to ambient pressure conditions. Alternatively, the control valve assembly 52 could be a three-way, two coil spool valve of the type shown in U.S. Pat. No. 5,460,329 to Sturman, which is also incorporated by reference herein.

The injector body 54 is a conventional body utilized by known HEUI injectors 14. Preferably, the control valve assembly 52 is mounted to the injector body 54. The intensifier assembly 56, the needle valve assembly 58, and the variable VOP assembly 60 are preferably disposed within a cavity defined within the injector body 54. A plurality of fluid passages may be defined in the injector body 54 in order to admit fuel to the injector 14 and to discharge excess fuel from the injector 14.

The intensifier assembly 56 includes a plunger 72. The plunger 72 is translatably disposed within a plunger bore 74 defined in the injector body 54. The plunger 72 presents an actuating surface 76 that is the upper margin of the plunger 72, as depicted in FIG. 2. The concentric return spring 78 is disposed about a portion of the plunger 72. The return spring 78 exerts an upwardly directed bias on the plunger 72 tending to return the plunger 72 to its full upward disposition.

A fuel pressurization chamber 80 is defined beneath the plunger 72. The fuel pressurization chamber 80 is defined in part by the fuel pressurization surface 82 of the plunger 72. Preferably, the area of the actuating surface 76 is approximately seven times the area of the fuel pressurization surface 82. Accordingly, the pressurizing effect of the downward stroke of the plunger 72 on the fuel in the fuel pressurization chamber 80 is to magnify the pressure of the high pressure actuating fluid by a factor of 7:1, such that the fuel for injection attains a pressure seven times the pressure of the actuating fluid.

A fuel inlet 84 is defined in a sidewall of the fuel pressurization chamber 80. A check valve 86 is disposed in the fuel inlet 84. The fuel inlet 84 is in fluid communication with the fuel passage 44 for refilling the fuel pressurization chamber 80 after an injection event. The fuel pressurization chamber 80 is fluidly coupled by a high pressure fuel passage 88 to the needle valve assembly 58.

The fourth major assembly of the injector 14 is the needle valve assembly 58. The needle valve assembly 58 includes a needle valve 90. The needle valve 90 is translatably disposed within a needle bore 92 that is defined within the injector body 54.

The upper margin of the needle valve 90 presents a preferably flat circular surface comprising a needle back 94. A return spring 96 is disposed concentric with the needle valve 90. The return spring 96 bears on a shoulder 98 that comprises a portion of the needle valve 90. The return spring 96 is held in compressive engagement with the shoulder 98 by a retainer 100. The retainer 100 may be a washer disposed in a groove.

Figure 3:
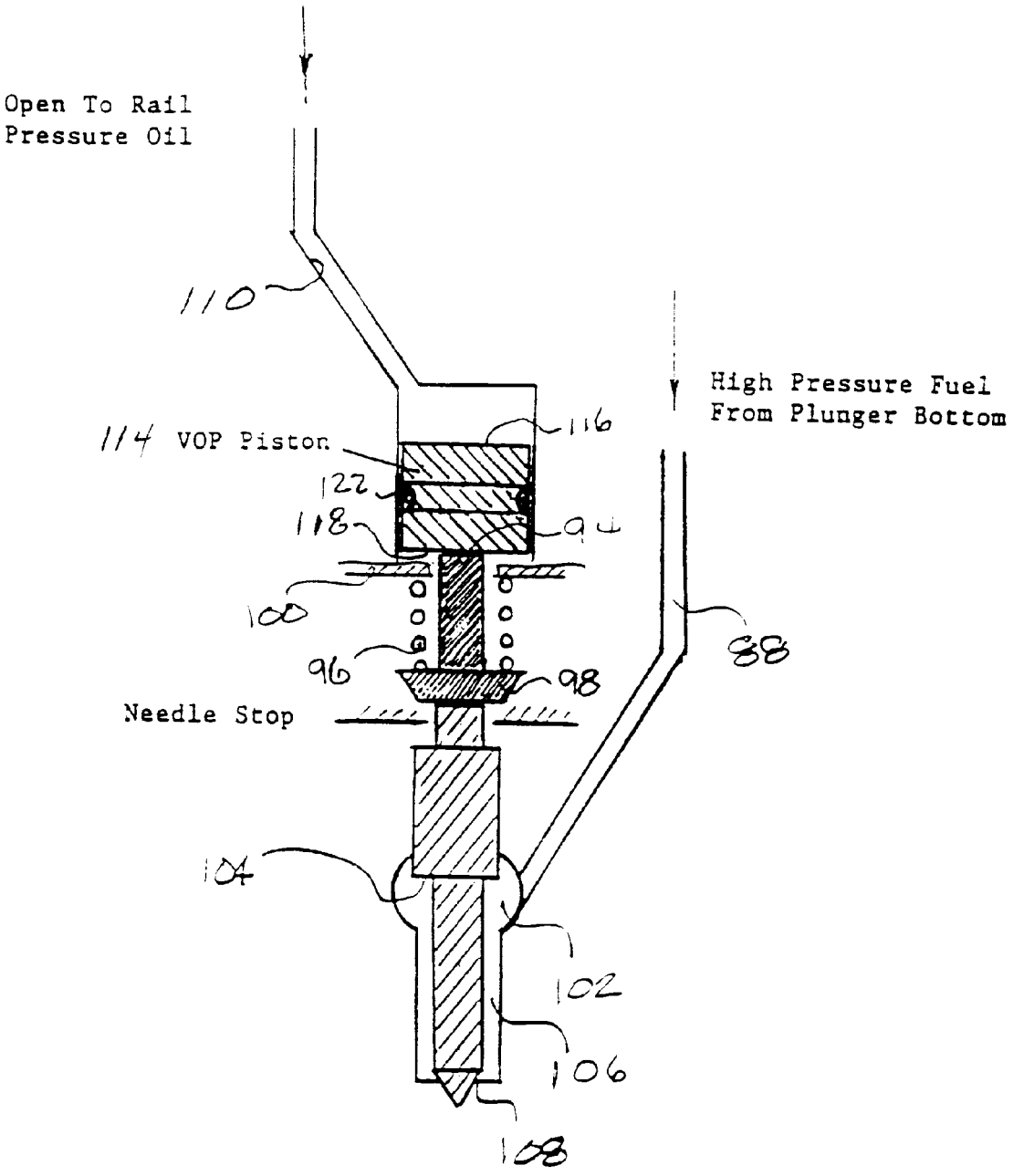
FIG. 3 is a sectional schematic representation of the present invention.

Referring to FIG. 3, a concentric high pressure chamber 102 is defined circumferential to the needle valve 90. A pressure face 104, comprising a portion of the needle valve 90, resides within the high pressure chamber 102. The high pressure chamber 102 is in fluid communication with the high pressure fuel passage 88. Fuel under pressure within the high pressure chamber 102 acts upward on the pressure face 104 to counter the closing bias of the return spring 96 and the pressure load on the VOP piston 114 from the actuating fluid. A descending concentric outlet passage 106 is defined circumferential to the needle valve 90 and fluidly connects the high pressure chamber 102 to an orifice 108 defined at the lower tip of the injector 14. Fuel discharged from the orifice 108 enters a combustion chamber of the diesel engine 12 for combustion therein.

The final major assembly of the HEUI injector 14 is the variable valve opening pressure (VOP) assembly 60 of the present invention. The variable VOP assembly 60 includes a high pressure actuating passage 110. The high pressure actuating passage 110 is in fluid communication with the actuating fluid high pressure rail 38. The high pressure actuating fluid passage 110 is further in fluid communication with a cylinder 112. The upper margin of the cylinder 112 is defined by a cylinder roof 113.

A piston 114 is translatably disposed within the cylinder 112. The upper margin of the piston 114 defines an actuating fluid pressure surface 116. The actuating fluid pressure surface 116 is preferably a generally circular flat surface. The opposed lower margin of the piston 114 defines a needle back surface 118. In a preferred embodiment, the needle back surface 118 is in physical engagement with the needle back 94 of the needle valve 90. A circumferential groove 120 is defined in the piston 114 between the actuating fluid pressure surface 116 and the needle back surface 118. A suitable seal 122 is disposed in the groove 120 to isolate the actuating fluid bearing on the actuating fluid pressure surface 116 from the fuel that flows to the lower portion of the needle valve 90.

In operation, the needle back surface 118 of the piston 114 is in direct contact with the needle back 94 of the needle valve 90. The actuating fluid pressure surface 116 of the variable VOP assembly 60 is exposed to high pressure actuating fluid from the actuating fluid high pressure rail 38 at all times. There is no valve to control the application of the actuating fluid pressure to the actuating fluid pressure surface 116 disposed between the rail 38 and the variable VOP assembly 60. There may, however, be one or more check valves (not shown) disposed between the rail 38 and the variable VOP assembly 60, for example, to prevent dynamic pressure waves from being communicated back to the rail 38. This is in distinction from certain prior art devices in which a fluid was selectively ported to the needle back 94 through the action of various valves. This distinction applies to the injector disclosed in U.S. Pat. No. 5,682,858, in which a solenoid 62 controls the porting and exhausting of a fluid to the needle back 94. In accordance with the above principle, the high pressure actuating fluid passage 110 is at all times in fluid communication with the actuating fluid high pressure rail 38. The high pressure actuating fluid passage 110 may be located either internal to the injector 14 (as by drilling through the injector body) or external to the injector 14 (as by a passageway defined in the cylinder head of the diesel engine 12). Other suitable means of connecting the actuating fluid high pressure rail 38 to the piston 114 of the variable VOP assembly 60 may be used as long as such means ensure that the high pressure actuating fluid is at all times present to the piston 114.

As indicated above, the actuating fluid pressure surface 116 of the piston 114 is being acted upon by the fluid pressure in the rail 38 at all times. The needle back surface 118 of the piston 114 is preferably vented to low pressure fuel (approximately 50 psi) at all times. The seal 122 prevents fluid leakage between the top of the piston 114 and the bottom of the piston 114, as depicted in FIG. 2.

The return spring 96 of the needle valve 90 is selected to exert an adequate closing force on the needle valve 90 to prevent the needle valve 90 from opening during engine 12 cranking conditions. At cranking (prior to engine start), there is very little pressure in the rail 38 that is available to act on the piston 114 and to assist the return spring 96 in preventing premature opening of the needle valve 90.

Figure 4A:
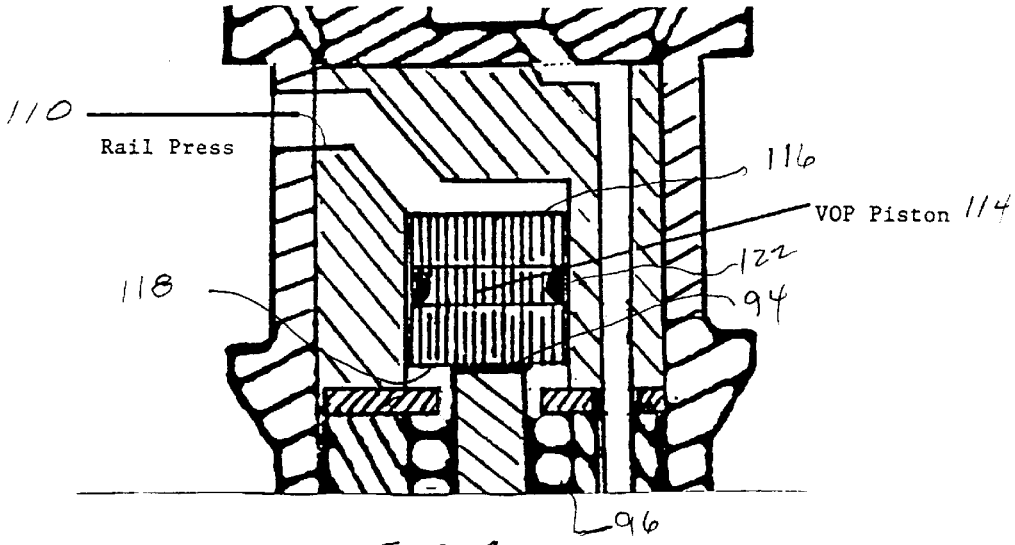
FIG. 4*a* is a sectional representation of a portion of the injector of FIG. 2 with the VOP piston at the bottom seat disposition.
Figure 4B:
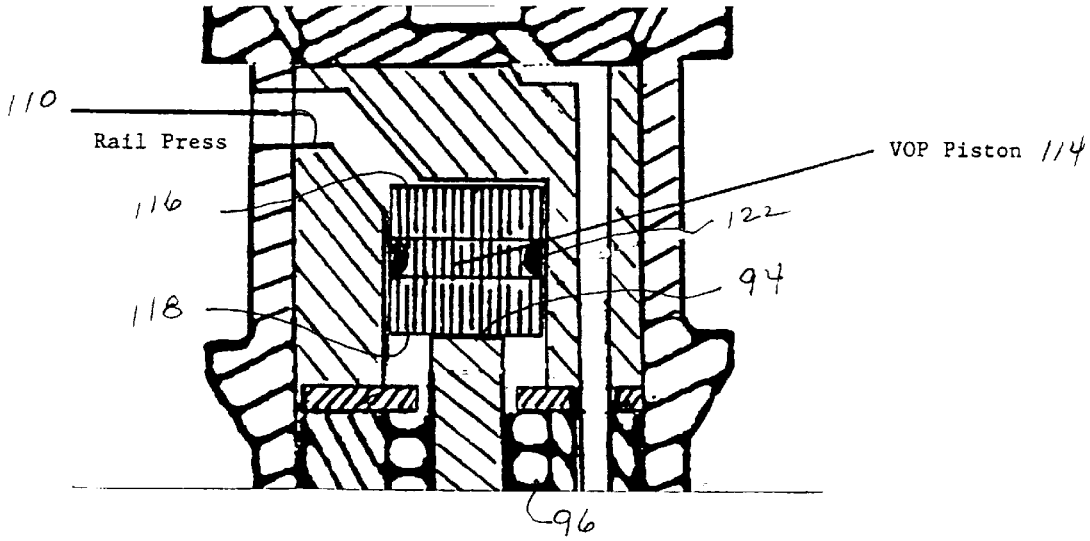
FIG. 4*b* is a sectional representation of FIG. 4*a* with the VOP piston at the top seat disposition.

Needle back surface 118 of the VOP piston 114 is always in mechanical contact with the needle back 94 of the needle valve 90. Piston 114 has two seating positions. When the needle valve 90 is closed (the noninjection cycle), the VOP piston 114 together with the needle valve 90 are at their lower seating position, as depicted in FIG. 4*a*. When the needle valve 90 is at its fully open position (during the injection cycle), the VOP piston 114 is lifted to its topmost position as depicted in FIG. 4*b*. In this topmost position, the actuating fluid pressure surface 116 of the piston 114 bears on the cylinder roof 113 of the cylinder 112. In such disposition, the cylinder roof 113 acts as a stop for both the VOP piston 114 and for the needle valve 90.

The actuating fluid high pressure rail 38 acts as a large accumulator for all the injectors 14 of the engine 12. The function of the rail 38 is to provide all injectors 14 with stable actuating fluid hydraulic pressure during the injection event. For all common rail HEUI type injection systems, pressure in the rail 38 is externally controlled by the controller 20 and RPCV 32 to maintain the pressure in the rail 38 at a preferred level at the given engine speed and the load condition. The actuating fluid pressure in the rail 38 is normally set at a very low pressure (approximately a 100–500 psi range) at engine idle conditions. The actuating fluid pressure in the rail 38 can be set relatively very high (approximately 3,500–4,000 psi) at the engine rated condition. Each setting of the actuating fluid pressure in the rail 38 is carefully selected to satisfy engine emission, noise, and driveability requirements. Generating a force on the actuating fluid pressure surface 116 of the piston 114 by means of the actuating fluid in the high pressure rail 38 provides a variable hydraulic force which changes with engine speed and load automatically. Actuating fluid pressure in the rail 38 is a relatively constant pressure source at any given operating condition due to the accumulator effect of the rail 38. Therefore, the hydraulic force produced by the actuating fluid from the rail 38 on the actuating fluid pressure surface 116 is relatively stable at any given engine operating condition. In addition to the bias of the return spring 96, the actuating fluid pressure acting on the actuating fluid pressure surface 116 produces a hydraulic force acting on the needle valve 90 at all times. This hydraulic force acts on the needle valve 90 both during the ejection event and during the noninjection cycle. The relationship between the needle valve 90 valve opening pressure (the fuel pressure necessary to open the needle valve 90 to commence the injection event) and the actuating fluid pressure in the rail 38 is a simple substantially linear relationship. Accordingly, the start of the injection event is delayed to a higher fuel injection pressure level as the actuating pressure in the rail 38 increases, as indicated by the noted linear relationship.

The area of the actuating fluid pressure surface 116 of the VOP piston 114 is required to be greater than the area of the pressure face 104 of the needle valve 90 in order to amplify the effect of the actuating fluid pressure. The ratio of the area of the actuating fluid pressure surface 116 to the area of the pressure face 104 may be between 1:1 and 6:1 Preferably, the area of the actuating fluid pressure surface 116 is approximately four times greater than the area of the pressure face 104. Given a 4:1 ratio, injection pressure of the fuel at which the opening of the needle valve 90 occurs can be estimated. Since the intensification ratio (the ratio of the area of the actuating surface 76 of the plunger 72 to the fuel pressurization surface 82 of the plunger 72) is about seven, the maximum fuel injection pressure (the pressure in the high pressure chamber 102) of the needle valve assembly 58 is about seven times the pressure of the actuating fluid in the rail 38. If the bias of the return spring 96 of the needle valve 90 is ignored, the needle valve 90 opens when the injection fuel pressure reaches four times the pressure of the actuating fluid in the rail 38. This estimation may be made as indicated below:

(1) At the rated engine condition (high speed, high load), the engine 12 normally runs with a relatively high pressure in the actuating fluid high pressure rail 38. Such pressure may be on the order of approximately 4,000 psi. With the aforementioned 4:1 area ratio, the needle valve 90 will open at approximately 16,000 psi fuel injection pressure. In the prior art HEUI injector, i.e., without the VOP piston assembly of the invention, the needle would open against a fixed spring load, normally at about 3000 psi under all conditions.

(2) At the engine idle condition, actuating fluid pressure in the actuating of fluid high pressure rail 38 is around 400 psi. Again, with the 4:1 area ratio, the needle valve 90 opening pressure is approximately 1,600 psi at idle.

With the variable VOP assembly 60 of the present invention, the return spring 96 of the needle valve 90 can be made to exert a substantially less force on the needle valve 90 than a convention return spring 96 used alone, since the return spring 96 alone establishes a fixed (unvariable) VOP. Physically, the return spring 96 used with the variable VOP assembly 60 of the present invention can be made substantially smaller than the conventional return spring 96. The return spring 96 usable with the present invention is sized to exert a force such that the needle valve 90 remains in the closed disposition when the actuating fluid of pressure in the rail 38 is not fully available and the combustion cylinder pressure in the engine 12 is at compression pressure level during the starting of engine 12. This is a significantly less force than required to be exerted by a conventional return spring 96. In a conventional injector system, relatively high return spring 96 force is required in order to provide a sharp end of fuel injection during the closing of the needle valve 90 at the end of the injection event. Further, such relatively high spring force is also required in order to keep needle valve 90 in the closed position when the engine cylinder pressure is relatively high during rated engine operating conditions. With the variable VOP assembly 60 of the present invention, both the valve opening pressure and the valve closing pressure are much higher than can be provided by a return spring 96 acting alone.

The variable VOP assembly 60 of the present invention delays the start of an injection event to a relatively higher fuel injection pressure level when actuating fluid pressure is high. It also closes the needle valve 90 at a relatively higher fuel injection pressure level. Such action beneficially makes the average injection pressure during an injection event significantly higher than a conventional system. Under normal operating conditions, the combustion cylinder pressure of the engine 12 increases with engine speed and load. Preferably, the desired rail pressure in the rail 38 is also increased by the controller 20. By causing the pressure of the actuating fluid in the actuating fluid high pressure rail 38 to bear on the needle valve 90, the back pressure acting on the needle valve 90 automatically increases as the engine 12 increases its load and speed.

Operation of the injector 14 incorporating the variable VOP assembly 60 of the present invention is as follows. During the non-injection cycle, the solenoid 62 of the control valve assembly 52 is in the off or closed position. The actuating surface 76 of the plunger 72 of the intensifier assembly 56 is vented by an outlet port 70 to ambient pressure. Fuel pressure in the fuel pressurization chamber 80 is maintained at the pressure of the low pressure fuel line 44. preferably approximately 50 psi at all times. This same pressure is maintained in the high pressure fuel chamber 102 defined around the needle valve 90. The VOP piston 114 is at its bottom seated disposition (as depicted in FIG. 4*a*) as a result of the actuating fluid in the high pressure rail 38 bearing on the actuating fluid pressure surface 116. The bias exerted by the needle return spring 96 of the needle valve 90 together with the force of the actuating fluid acting on the VOP piston 114 acts to maintain the needle valve 90 in its lower seated (closed) position.

To commence an injection event, solenoid 62 is cycled to its open disposition. In the open disposition, high pressure actuating fluid flows from the high pressure actuating fluid passage 64 via the solenoid 62 and the inlet port 68 to act upon the pressurization surface 76 of the intensifier assembly 56. The pressure on the pressurization surface 76 generates a force tending to drive the intensifier plunger 72 downward, thereby increasing the pressure of the fuel in the fuel pressurization chamber 80. Injection pressure builds quickly responsive to the downward motion of the plunger 72. When the injection pressure in the high pressure chamber 102 acting upward on the pressure face 104 of the needle valve 90 generates a force exceeding the total force generated by the needle return spring 96 and the variable hydraulic force on the VOP piston 114, the needle valve 90 reaches the valve opening pressure level for the selected actuating fluid pressure. Responsive thereto, the needle valve 90 starts to open. The needle valve 90 lifts upward, as depicted in FIG. 4, carrying the VOP piston 114 to its top seat position against roof 113 of cylinder 112. The actuating fluid in the cylinder 112 is discharged back to the rail 38 as the VOP piston 114 rises to its top seated position.

Fuel injection from the orifice 108 commences as soon as the needle valve 90 unseats from its downward closed disposition. Compared to a prior art injection system having only a convention return spring 96, the start of injection with the present invention is primarily a function of pressure of the actuating fluid in the actuating fluid high pressure rail 38, as distinct from being a function of the force exerted by the needle return spring 96.

At the end of the injection event, the solenoid 62 of the control valve assembly 52 is cycled to its off (closed) disposition. This action causes the actuating fluid bearing on the pressurization surface 76 to be vented to ambient via the outlet port 70, the solenoid valve 62, and the ambient actuating fluid passage 66. The plunger 72 translates upward as a result of the bias exerted thereon by the return spring 78 and fuel pressure to the needle valve 90 decays dramatically. The needle valve 90 cannot sustain its open position due to the loss of fuel injection pressure. The needle valve 90 closes under the influence of the return spring 96 and the force being exerted by the actuating fluid on the VOP piston 114 to quickly terminate the fuel injection event. During the needle valve 90 return from the upward open disposition to the downward closed disposition, the VOP piston 114 follows the needle valve 90 and returns to the bottom seated position as depicted in FIG. 4*a*. The VOP piston 114 will stay in this disposition until the next injection cycle.

A round trip of the solenoid 62 is defined as solenoid motion from its closed seat to its open seat and return to its closed seat. There is a concern with certain HEUI type injectors of the uncontrolled and unrepeatable injection that results when the solenoid 62 commences its travel from the closed disposition to the open disposition and is recalled to the closed disposition prior to seating in the open disposition, less than a round trip. The higher valve opening pressure resulting from the present invention generates a longer hydraulic delay prior to opening of the needle valve 90. This delay provides sufficient time to ensure than no injection occurs during the previously described partial motion less than a round trip of the solenoid 62 and allows the use of the solenoid 62 to obtain a desired smaller volume of pilot injection at full solenoid 62 round trip travel. Further, reduction of the physical size of the return spring 96 of the needle valve 90 provides for more space within the injector 14. Such space is always at a premium for designing desired features into the injector 14. Additionally, certain HEUI-type injectors currently have a valve opening pressure of approximately 3,000 psi. By adding the variable VOP assembly 60 of the present invention to such an injector 14, the valve opening pressure is advantageously less than the base line valve opening pressure (3,000 psi) at lower pressures of the actuating fluid of the high pressure rail 38 and the valve opening pressure is advantageously significantly higher than the base line VOP at higher pressures of the actuating fluid in the actuating fluid high pressure rail 38.

The above description of the present invention is exemplary only and not intended to limit the scope of the present application. Other aspects, objects, and advantages of this invention can be obtained from a study of the drawings, the disclosure, and the appended claims.

What is claimed is:

1. A hydraulically-actuated electronically-controlled fuel injector for use with a fuel injection system having an actuating fluid high pressure common rail for conveying an actuating fluid under pressure, the pressure of the actuating fluid in the common rail being selectively variable, the fuel injection system being installed on a diesel engine, the injector having a controller valve for selectively porting the actuating fluid to an injector intensifier assembly for magnifying the pressure of the file to be injected; comprising:

a needle valve for controlling the opening and closing of a fuel injection orifice to effect a fuel injection event, the needle valve being shiftable between a closed disposition and an open disposition, a return spring exerting a bias on the needle valve tending to urge the needle valve into the closed disposition, and a variable valve opening pressure assembly being operably couplable to the needle valve and being in fluid communication with the actuating fluid in the common rail for continuously exposing the needle valve to actuating fluid pressure, the actuating fluid exerting a selectively variable bias on the needle valve, the bias exerting a force on the needle valve tending to urge the needle valve into the closed disposition, the selectively variable bias effecting a variable needle valve valve opening pressure.

2. The fuel injector of claim 1 providing a low needle valve valve opening pressure at low engine speed and load conditions and providing a high needle valve valve opening pressure at high engine speed and load conditions.

3. The fuel injector of claim 1 wherein the variable needle valve valve opening pressure bears a linear relationship with respect to variance of the actuating fluid pressure.

4. The fuel injector of claim 2 wherein the high needle valve valve opening pressure acts to effect a relatively high average fuel injection pressure.

5. The fuel injector of claim 2 wherein the high needle valve valve opening pressure acts to delay the start of fuel injection.

6. The fuel injector of claim 5 wherein the high needle valve valve opening pressure acts to delay the start of fuel injection for a time that is at least as great as the time required for the controller valve to complete a round trip.

7. The fuel injector of claim 2 wherein the high needle valve valve opening pressure acts to abruptly terminate fuel injection while fuel injection pressure is high.

8. The fuel injector of claim 1 wherein the start of fuel injection is automatically delayed to a higher fuel injection pressure as the pressure of the actuating fluid in the common rail is increased.

9. The fuel injector of claim 1 wherein the needle valve valve opening pressure is less than six times greater than the pressure of the actuating fluid.

10. The fuel injector of claim 9 wherein the needle valve valve opening pressure is substantially four times greater than the pressure of the actuating fluid.

11. The fuel injector of claim 1 wherein the variable valve opening pressure assembly includes a piston, the piston being translatably disposed in a cylinder defined in an injector body, the piston being translatable responsive to a force generated by the pressure of the actuating fluid.

12. The injector of claim 11 further including a passage defined in the injector body, the passage being in fluid communication with the common rail and in fluid communication with the piston for providing fluid communication between the common rail and the piston.

13. The injector of claim 12 wherein the piston presents a first pressure bearing surface in fluid communication with the common rail and a generally opposed second surface, the second surface being operably couplable to the needle valve.

14. The injector of claim 13 wherein the needle valve presents a needle back surface, the piston second surface bearing on the needle back surface.

15. The injector of claim 13 wherein the piston further includes a piston seal, the piston seal fluidly isolating the first pressure bearing surface from the second surface.

16. The injector of claim 13 wherein the needle valve presents a pressure face, the pressure face being presented to high pressure fuel, the high pressure fuel for exerting a force on the pressure face, the force tending to open the needle valve, the area of the piston first pressure bearing surface being greater than the area of the needle valve pressure face.

17. The injector of claim 16 wherein the ratio of the area of the piston first pressure bearing surface is to the area of the needle valve pressure face is less than 6:1.

18. The injector of claim 17 wherein the ratio of the area of the piston first pressure bearing surface is to the area of the needle valve pressure face is substantially 4:1.

19. The injector of claim 1 wherein the needle valve includes a valve return spring, the return spring exerting a bias on the needle valve tending to urge the needle valve in the closed disposition, the bias of the return spring being sufficient to maintain the needle valve in the closed disposition against combustion forces acting on the needle valve developed in the engine during cranking operation of the engine, the bias exerted by the variable valve opening pressure assembly supplying the greatest portion of the total bias acting on the needle valve during normal engine operation.

20. The injector of claim 12 wherein the passage defined in the injector body is characterized by the absence a pressure control valve between the common rail and the piston.

21. A method of varying the valve opening pressure of an injector valve of a fuel injector, the injector being operably coupled to a diesel engine and being controlled by a controller valve, comprising the steps of:

operably fluidly coupling the injector valve directly to a source of actuating fluid under pressure;

continuously exposing the injector valve to actuating fluid pressure;

biasing the injector valve in a closed disposition by means of the actuating fluid under pressure; and selectively varying the pressure of the actuating fluid to vary the bias acting on the injector valve, the variable bias defining in part a variable force which must be overcome in order to open the injector valve.

22. The method of claim 21 including the step of biasing the injector valve in a closed disposition by means of a spring, the spring bias acting in cooperation with the bias generated by the pressure of the actuating fluid.

23. The method of claim 22 including the step of generating a low valve opening pressure at low engine speed and load conditions.

24. The method of claim 22 including the step of generating a high valve opening pressure at high engine speed and load conditions.

25. The method of claim 21 including the step of varying the valve opening pressure substantially linearly with respect to variance of the actuating fluid pressure.

26. The method of claim 24 including the step of generating a higher average fuel injection pressure.

27. The method of claim 21 including the step of delaying the start of fuel injection by means of a high valve opening pressure.

28. The method of claim 27 including the step of delaying the start of fuel injection for a time that is at least as long as the time required for the controller valve to complete a round trip.

29. The method of claim 24 including the step of ceasing fuel injection by closing the injector valve abruptly while the fuel injection pressure is high.

30. The method of claim 21 including the step of generating a valve opening pressure that is less than six times greater than the pressure of the actuating fluid.

31. The method of claim 30 including the step of generating a valve opening pressure that is substantially four times greater than the pressure of the actuating fluid.

32. A hydraulically-actuated electronically-controlled fuel injection system having an injector, the injector having a controller valve for selectively porting an actuating fluid to an injector intensifier assembly for magnifying the pressure of the fuel to be injected; comprising:

a needle valve for controlling the opening and closing of a fuel injection orifice to effect a fuel injection event, the needle valve being shiftable between a closed disposition and an open disposition, a return spring exerting a bias on the needle valve tending to urge the needle valve into the closed disposition;

an actuating fluid high pressure common rail for conveying an actuating fluid under pressure, the pressure of the actuating fluid in the common rail being selectively variable; and a variable opening pressure assembly being operably couplable to the needle valve and being adapted for continuous fluid communication of the actuating fluid from the common rail thereto, the actuating fluid exerting a selectively variable bias for transmission to the needle valve, the bias exerting a force on the needle valve tending to urge the needle valve into the closed disposition, the selectively variable bias effecting a variable needle valve valve opening pressure.

33. The fuel injection system of claim 32 providing a low needle valve valve opening pressure at low engine speed and load conditions and providing a high needle valve valve opening pressure at high engine speed and load conditions.

34. The fuel injection system of claim 32 wherein the variable needle valve valve opening pressure bears a linear relationship with respect to variance of the actuating fluid pressure.

35. The fuel injection system of claim 33 wherein the high needle valve valve opening pressure acts to effect a relatively high average fuel injection pressure.

36. The fuel injection system of claim 33 wherein the high needle valve valve opening pressure acts to delay the start of fuel injection.

37. The fuel injection system of claim 36 wherein the high needle valve valve opening pressure acts to delay the start of fuel injection for a time that is at least as great as the time required for the controller valve to complete a round trip.

38. The fuel injection system of claim 33 wherein the high needle valve valve opening pressure acts to abruptly terminate fuel injection while fuel injection pressure is high.

39. The fuel injection system of claim 32 wherein the start of fuel injection is automatically delayed to a higher fuel injection pressure as the pressure of the actuating fluid in the common rail is increased.

40. The fuel injection system of claim 32 wherein the needle valve valve opening pressure is less than six times greater than the pressure of the actuating fluid.

41. The fuel injection system of claim 40 wherein the needle valve valve opening pressure is substantially four times greater than the pressure of the actuating fluid.

42. The fuel injection system of claim 32 wherein the variable valve opening pressure assembly includes a piston, the piston being translatably disposed in a cylinder defined in an injector body, the piston being translatable responsive to a force generated by the pressure of the actuating fluid.

43. The injection system of claim 42 further including a passage defined in the injector body, the passage being in fluid communication with the common rail and in fluid communication with the piston for providing fluid communication between the common rail and the piston.

44. The injection system of claim 42 wherein the piston presents a first pressure bearing surface in fluid communication with the common rail and a generally opposed second surface, the second surface being operably couplable to the needle valve.

45. The injection system of claim 44 wherein the needle valve presents a needle back surface, the piston second surface bearing on the needle back surface.

46. The injection system of claim 44 the piston further including a piston seal, the piston seal fluidly isolating the first pressure bearing surface from the second surface.

47. The injection system of claim 44 wherein the needle valve presents a pressure face, the pressure face being presented to high pressure fuel, the high pressure fuel for exerting a force on the pressure face, the force tending to open the needle valve, the area of the piston first pressure bearing surface being greater than the area of the needle valve pressure face.

48. The injection system of claim 47 wherein the ratio of the area of the piston first pressure bearing surface is to the area of the needle valve pressure face is less than 6:1.

49. The injection system of claim 48 wherein the ratio of the area of the piston first pressure bearing surface is to the area of the needle valve pressure face is substantially 4:1.

50. The injection system of claim 32 wherein the needle valve includes a valve return spring, the return spring exerts a bias on the needle valve tending to urge the needle valve in the closed disposition, the bias of the return spring being sufficient to maintain the needle valve in the closed disposition against combustion forces acting on the needle valve developed in the engine during cranking operation of the engine, the bias exerted by the variable valve opening pressure assembly supplying the greatest portion of the total bias acting on the needle valve during normal engine operation.

51. The injection system of claim 43 wherein the passage defined in the injector body is characterized by the absence a pressure control valve between the common rail and the piston.

* * * * *